US009134743B2

(12) United States Patent
Bisson et al.

(10) Patent No.: US 9,134,743 B2
(45) Date of Patent: Sep. 15, 2015

(54) LOW-DROPOUT VOLTAGE REGULATOR

(75) Inventors: Glovanni Bisson, Padua (IT); Marco Flaibani, Padua (IT); Marco Piselli, Padua (IT)

(73) Assignee: Infineon Technologies Austria AG, Villach (AT)

( * ) Notice: Subject to any disclaimer, the term of this patent is extended or adjusted under 35 U.S.C. 154(b) by 173 days.

(21) Appl. No.: 13/459,817

(22) Filed: Apr. 30, 2012

(65) Prior Publication Data

US 2013/0285631 A1 Oct. 31, 2013

(51) Int. Cl.
*G05F 1/56* (2006.01)
*G05F 1/575* (2006.01)

(52) U.S. Cl.
CPC ..... *G05F 1/575* (2013.01)
USPC ..... 323/280

(58) Field of Classification Search
USPC ..... 323/271, 273, 276, 280–290, 311, 313, 323/316; 327/536, 538, 540, 362
See application file for complete search history.

(56) References Cited

U.S. PATENT DOCUMENTS 4,794,507 A * 12/1988 Cavigelli ..... 363/86
5,132,552 A * 7/1992 Ito et al. ..... 327/100
5,589,759 A * 12/1996 Borgato et al. ..... 323/222
5,850,139 A 12/1998 Edwards
5,929,616 A * 7/1999 Perraud et al. ..... 323/274
5,945,819 A * 8/1999 Ursino et al. ..... 323/282
5,952,817 A * 9/1999 Brewster et al. ..... 323/268
5,962,817 A * 10/1999 Rodriguez ..... 177/126
6,469,480 B2 * 10/2002 Kanakubo ..... 323/269
7,443,149 B2 * 10/2008 Nishimura et al. ..... 323/280
7,495,422 B2 * 2/2009 Mok et al. ..... 323/280
7,710,091 B2 * 5/2010 Huang ..... 323/280
7,746,047 B2 * 6/2010 Yin et al. ..... 323/273
7,821,240 B2 * 10/2010 Oddoart et al. ..... 323/269
7,928,706 B2 * 4/2011 Do Couto et al. ..... 323/273

(Continued)

FOREIGN PATENT DOCUMENTS

CN 101256421 A 9/2008
CN 101303609 A 11/2008
CN 101667046 A 3/2010

OTHER PUBLICATIONS

"300 mA, High PSRR, Low Quiescent Current LDO," Microchip MCP 1802, 2010, 28 pages, Microchip Technology Inc.

(Continued)

*Primary Examiner* — Rajnikant Patel
(74) *Attorney, Agent, or Firm* — Slater & Matsil, L.L.P.

(57) ABSTRACT

A low-dropout voltage regulator includes a power transistor configured to receive an input voltage and to provide a regulated output voltage at an output voltage node. The power transistor includes a control electrode configured to receive a driver signal. A reference circuit is configured to generate a reference voltage. A feedback network is coupled to the power transistor and is configured to provide a first feedback signal and a second feedback signal. The first feedback signal represents the output voltage and the second feedback signal represents an output voltage gradient. An error amplifier is configured to receive the reference voltage and the first feedback signal representing the output voltage. The error amplifier is configured to generate the driver signal dependent on the reference voltage and the first feedback signal. The error amplifier includes an output stage that is biased with a bias current responsive to the second feedback signal.

21 Claims, 2 Drawing Sheets

(56) References Cited

U.S. PATENT DOCUMENTS

| | | | | |
|---|---|---|---|---|
| 7,986,499 | B2 | 7/2011 | Wang et al. | |
| 2003/0214275 | A1 | 11/2003 | Biagi | |
| 2009/0001953 | A1 | 1/2009 | Huang | |
| 2011/0018507 | A1* | 1/2011 | McCloy-Stevens et al. .. | 323/271 |
| 2011/0254514 | A1* | 10/2011 | Fleming ..... | 320/166 |

OTHER PUBLICATIONS

Rincon-Mora, G.A., et al., "A Low Voltage, Low Quiescent Current, Low Drop-Out Regulator," IEEE Journal of Solid-State Circuits, Jan. 1998, 9 pages, vol. 33, No. 1.

"CircuitVision Analysis on the Microchip Technology MCP1802T Voltage Regulator," Techinsights, Infineon Technologies AG, Feb. 2011, 39 pages.

* cited by examiner

LOW-DROPOUT VOLTAGE REGULATOR

TECHNICAL FIELD

The present invention generally relates to the field of DC linear voltage regulators, particularly to low-dropout regulators (LDO regulators) having a low quiescent current as well as a high power supply rejection ratio (PSRR).

BACKGROUND

The demand for low drop-out (LDO) regulators is increasing because of the growing demand for portable electronics, i.e., cellular phones, laptops, etc. LDO regulators are used together with DC-DC converters and as standalone parts as well. The need for low supply voltages is innate to portable low power devices and also a result of lower breakdown voltages due to a reduction of feature size. A low quiescent current in a battery-operated system is an important performance parameter because it—at least partially—determines battery life. In modern power management units LDO regulators are typically cascaded onto switching regulators to suppress noise and ripple due to the switching operation and to provide a low noise output. Thus, one important parameter which is relevant to the performance of an LDO is power supply rejection ratio (PSRR). The higher the PSRR of an LDO regulator the lower the ripple at its output given a certain ripple at its input caused by a switching converter. Other important parameters are the quiescent current, which should be low for a good current efficiency, and the step response, which should be fast to sufficiently suppress output voltage swings resulting to variations of the load current.

When trying to optimize these three parameters one has to face conflicting objectives. For example, a regulator which exhibits a fast step response will usually have a higher quiescent current than a slow regulator. Thus, there is a need for improved low-dropout regulators.

SUMMARY OF THE INVENTION

A low-dropout (LDO) voltage regulator is described. In accordance with one example of the present invention the LDO voltage regulator includes a power transistor receiving an input voltage and providing a regulated output voltage at an output voltage node. The power transistor has a control electrode receiving a driver signal. The LDO voltage regulator further includes a reference circuit for generating a reference voltage and a feedback network that is coupled to the power transistor and configured to provide a first and a second feedback signal. The first feedback signal represents the output voltage and the second feedback signal represents the output voltage gradient. Furthermore the LDO voltage regulator includes an error amplifier that receives the reference voltage and the first feedback signal representing the output voltage. The error amplifier is configured to generate the driver signal which depends on the reference voltage and the first feedback signal. The error amplifier comprises an output stage which is biased with a bias current responsive to the second feedback signal.

Furthermore, the feedback network may be configured to provide a third feedback signal that represents an output current of the power transistor. In this case the error amplifier comprises an output stage which is biased with a bias current responsive to the second and the third feedback signal.

BRIEF DESCRIPTION OF THE DRAWINGS

The invention can be better understood with reference to the following drawings and description. The components in the figures are not necessarily to scale, instead emphasis being placed upon illustrating the principles of the invention. Moreover, in the figures, like reference numerals designate corresponding parts. In the drawings.

DETAILED DESCRIPTION OF ILLUSTRATIVE EMBODIMENTS

Figure 1:
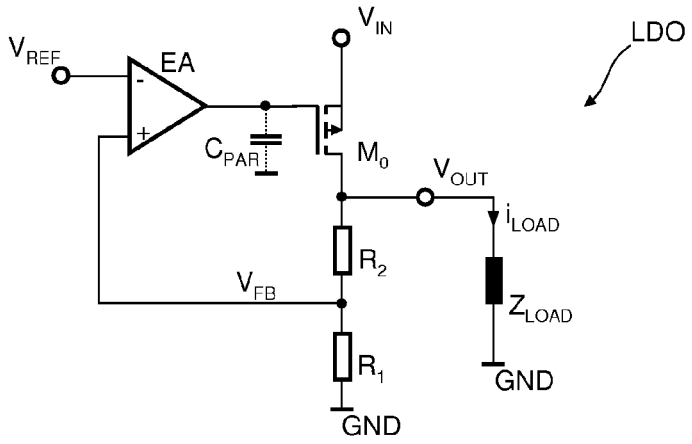
FIG. 1 is a circuit diagram illustrating a typical low-dropout regulator topology.

As mentioned above it is imperative to use low-dropout (LDO) regulators in many applications, such as automotive, portable, industrial, and medical applications. Particularly, the automotive industry requires LDO regulators to power up digital circuits, especially during cold-crank conditions where the battery voltage can be below 6 V. The increasing demand, however, is especially apparent in mobile battery-driven products, such as cellular phones, digital camera, laptops, or the like. In a cellular phone, for instance, switching converter are used to boost up the voltage and LDO regulators are cascaded in series to suppress the noise which is inevitably generated by switching converters due to the switching operation. LDO regulators can be operated at comparatively low input voltages and power consumption is minimized accordingly. Low voltage drop and low quiescent current are imperative circuit characteristics when a long battery life cycle is aimed at. The requirement for low voltage operation is also a consequence of process technology. This is because isolation barriers decrease as the component densities per unit area increase, which results in lower breakdown voltages. Therefore, low power and finer lithography require regulators to operate at low voltages, to produce precise output voltages, and have a lower quiescent current flow. Drop-out voltages also need to be minimized to maximize dynamic range within a given power supply voltage. This is because the signal-to-noise ratio (SNR) typically decreases as the power supply voltages decrease while noise remains constant.

Current efficiency $\eta_{CURRENT}$ is an important characteristic of battery-powered products. It is defined as the ratio of the load-current $i_{LOAD}$ to the total battery drain current $i_{LOAD}+i_Q$, which includes load-current $i_{LOAD}$ and the quiescent current $i_Q$ of the regulator and is usually expressed as percentage:

$$\eta_{CURRENT}=i_{LOAD}/(i_{LOAD}+i_Q) \quad (1)$$

The current efficiency determines how much battery lifetime is degraded by the mere existence of the regulator. Battery life is restricted by the total electric charge stored in the battery (also referred to as "battery capacity" and usually measured in ampere-hours). During operating conditions where the load-current is much greater than the quiescent current, operation lifetime is essentially determined by the load-current as the impact of the quiescent current of the total current drain is negligible. However, the effects of the quiescent current on the battery lifetime are most relevant during low load-current operating conditions when current efficiency is low. For many applications, high load-currents are usually drained during comparatively short time intervals, whereas the opposite is true for low load-currents, which are constantly drained during stand-by and idle times of an electronic circuit. As a result, current efficiency plays a pivotal role in designing battery-powered supplies.

The two key parameters which primarily limit the current efficiency of LDO regulators are the maximum load-current $i_{MAX}$ and requirements concerning transient output voltage variations, i.e. the step response of the regulator. Typically, more quiescent current flow is necessary for improved performance with respect to these parameters.

FIG. 1 illustrates the general components of a typical low drop-out regulator LDO, namely, an error amplifier EA, a pass device $M_0$, a reference circuit (not shown) providing the reference voltage $V_{REF}$, a feedback network which, in the present example includes the resisters $R_1$ and $R_2$ that form a voltage divider. In the present example the pass device is a power p-channel MOS transistor having a (parasitic) gate capacitance labelled $C_{PAR}$ in FIG. 1. The pass device $M_0$ is connected between an input circuit node that is supplied with an (e.g. unregulated) input voltage $V_{IN}$ and an output circuit note providing a regulated output voltage $V_{OUT}$. A load may be connected between the output circuit node and a reference potential, e.g. ground potential. In the present example the load is generally represented by the impedance $Z_{LOAD}$. The feedback network ($R_1$, $R_2$) is also connected to the output node to feed a signal representative of the output voltage $V_{OUT}$ back to the error amplifier EA. In the present example, the voltage divider $R_1$, $R_2$ is connected between the output node and the reference (ground) potential; and a feedback voltage $V_{FB}=R_1/(R_1+R_2)$ being a fraction of the output voltage $V_{OUT}$ is tapped at the middle tap of the voltage divider and supplied to the error amplifier EA thus closing the control loop. The error amplifier EA is configured to provider a control signal $V_G$ to the pass device, whereby the control signal $V_G$ is a function of the feedback signal $V_{FB}$ and the reference voltage $V_{REF}$. In the present example the error amplifier amplifies the difference $V_{FB}-V_{REF}$.

In a steady state the error amplifier drives the MOS transistor $M_0$ such that the feedback voltage $V_{FB}$ equals the reference voltage $V_{REF}$ and thus the following equation holds true $$V_{OUT}=(R_1+R_2)\cdot V_{FB}/R_1=(R_1+R_2)\cdot V_{REF}/R_1. \quad (2)$$

When the output voltage is too high ($V_{FB}>V_{REF}$) the output signal level of the error amplifier EA is increased thus driving the p-channel MOS transistor to a higher on-resistance which reduces the output voltage. When the output voltage is too low ($V_{FB}<V_{REF}$) the control loop acts vice versa and the output voltage $V_{OUT}$ approaches the desired level $(R_1+R_2)\cdot V_{REF}/R_1$.

It should be noted that the power MOS transistor $M_0$ forms a (parasitic, but significant) capacitive load for the error amplifier. The respective capacitance is depicted as (parasitic) capacitor $C_{PAR}$ in FIG. 1. Output current and input voltage range directly affect the required characteristics of the MOS transistor $M_0$ of the LDO regulator. Particularly the size of the MOS transistor defines the current requirements of the error amplifier. As the maximum load-current specification increases, the size of the MOS transistor $M_0$ necessarily increases. Consequently, the amplifier's load capacitance $C_{PAR}$ increases (see FIG. 1). This affects the circuit's bandwidth by reducing the value of the pole due to the parasitic capacitance $C_{PAR}$ present at the output of the error amplifier EA. Therefore, phase-margin degrades and stability may be compromised unless the output impedance of the amplifier is reduced accordingly. As a result, more current in the output stage of the error amplifier EA is required. Low input voltages have the same negative effects on frequency response and quiescent current as just described with regard to load-current. This is because the voltage swing of the gate voltage decreases as the input voltages decreases, thereby demanding a larger MOS transistor to achieve high output currents.

Further limits to low quiescent current arise from the transient requirements of the regulator, namely, the permissible output voltage variation in response to a maximum load-current step. The output voltage variation is determined by the response time of the closed-loop circuit, the specified load-current, and the output capacitor (implicit in FIG. 1 as included in load impedance $Z_L$). The worst case response time corresponds to the maximum output voltage variation. This response time is determined by the closed-loop bandwidth of the system and the output slew-rate current of the error amplifier EA. Requirements concerning these two factors (closed-loop bandwidth and slew-rate) are more difficult to comply with as the size of the parasitic capacitor $C_{PAR}$ at the output of the amplifier EA increases, which results from a low voltage drop and/or high output current specification. Consequently, the quiescent current of the amplifier's gain stage is defined by a minimum bandwidth while the quiescent current of the amplifier's buffer stage is defined by the minimum slew-rate required to charge and discharge the parasitic capacitance $C_{PAR}$. As a general result it can be hold that a higher maximum load current, a lower voltage drop and a lower output voltage variation results in a higher quiescent current and a lower current efficiency of the LDO regulator.

Figure 2:
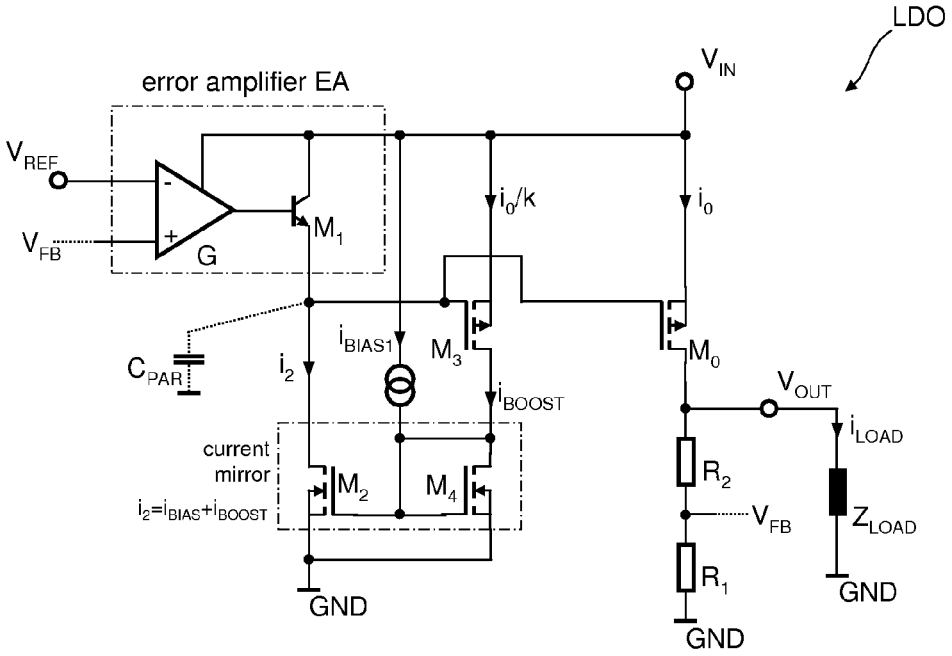
FIG. 2 is a circuit diagram illustrating an alternative low-dropout regulator topology.

One improved circuit, depicted in FIG. 2, has been discussed in the publication G. A. Rincon-Mora, P. E. Allen, "*A Low-Voltage, Low Quiescent Current, Low Drop-Out Regulator,*" in: *IEEE Journal of Solid-State Circuits*, Vol. 33, No. 1, 1998. The circuit of FIG. 2 essentially corresponds to the circuit of FIG. 1. However, the implementation of the error amplifier EA, which includes a gain stage and a buffer stage, and the feedback network are different. Particularly the buffer stage has been improved as compared to the basic example of FIG. 1 which uses a standard amplifier EA. The basic idea behind the function of the buffer stage of the error amplifier EA of FIG. 2 is to sense the output current of the regulator (using a sense transistor $M_3$) and feed back a ratio 1/k of the output current to the slew-rate limited circuit node at the gate of the power MOS transistor $M_0$. As mentioned above, the limited slew-rate is due to the parasitic capacitance $C_{PAR}$ inherently present in a power MOS transistor. The sense transistor $M_3$ has a common source and a common gate terminal and thus drains a defined fraction (current $i_{BOOST}=i_0/k$) of the current $i_0$ flowing through the power MOS transistor $M_0$. The power transistor $M_0$ and the sense transistor are usually integrated in the same transistor cell field wherein the power transistor is composed of k times as much parallel transistor cells as the sense transistor. Such power MOS transistor arrangements including sense transistor cells are—as such—known in the field and not further discussed here. As mentioned the sense current (denoted as $i_{BOOST}$ in FIG. 2) is a fraction 1/k of the output current $i_0$ which flows through the source-drain-current path of the power MOS transistor $M_0$. The sense current (also referred to as boost current in the present example) $i_{BOOST}$ is drained to a reference potential (ground potential GND) via a current minor composed of the transistors $M_4$ (current mirror input transistor) and $M_2$ (current mirror output transistor) which are implemented as n-channel MOS transistors in the present example. A bias current source is also coupled to the input transistor $M_4$ of the current minor such that the mirror current $i_2$ is the sum of the bias current $i_{BIAS1}$ and the boost current $i_{BOOST}$, that is $i_2=i_{BIAS1}+i_0/k$. The mirror current $i_2$ is sourced by the npn-type bipolar junction transistor $M_1$ (BJT) which is connected between the circuit node supplied with the input voltage $V_{IN}$ and the current minor output transistor $M_2$. The base of the BJT $M_1$ is driven by the gain stage G of the error amplifier. The BJT $M_1$ operates as a simple emitter follower, that is, the emitter potential of the transistor $M_1$ follows the potential of the gain stage output. Furthermore, the emitter is coupled to the gate of the power MOS transistor $M_0$ and thus the emitter potential equals the gate voltage of the power MOS transistor $M_0$.

The quiescent current flowing through the collector-emitter current path of the BJT $M_1$ equals the mirror current is $$i_2(t)=i_{BIAS1}+i_0(t)/k. \quad (3)$$

During operating conditions with low load-current $i_{LOAD}$ (which is equal to the current $i_0$ as the current drained through the voltage divider $R_1$, $R_2$ is usually negligible), the current $i_{BOOST}=i_0/k$ fed back to the emitter follower is negligible. Consequently, the current through the emitter follower is simply $i_{BIAS1}$ (which may be designed to be comparatively low) when load-current $i_{LOAD}$ is low. During operating conditions with high load-current $i_{LOAD}$, the current through the emitter follower $M_1$ is increased by $i_{BOOST}$, which is no longer negligible. The resulting increase in quiescent current has an insignificant impact on current efficiency because the load-current is, at this time, much greater in magnitude. However, the increase in current in the buffer stage of the error amplifier (i.e. in the emitter follower $M_1$) aids the circuit by pushing the parasitic pole associated with the parasitic capacitor $C_{PAR}$ to higher frequencies and by increasing the current available for increase the slew-rate. Thus, the biasing (i.e. current $i_{BIAS1}$) for the case of zero load-current $i_{LOAD}$ can be designed to utilize a minimum amount of current, which yields maximum current efficiency and thus a prolonged battery life-cycle.

For regulating the output voltage of the LDO regulator, the gain stage G and the emitter follower (transistor $M_1$) adjust the gate potential of the power MOS transistor $M_0$. However, adjusting the gate potential of the power transistor $M_0$ requires a high current to charge or discharge the parasitic capacitance $C_{PAR}$. The full additional bias current $i_0/k$ provided by the current minor $M_2$, $M_4$ is, however, only available after an output current step thus causing a delay. During an output current step (i.e. while the output current is ramping up or down) the feedback loop of the regulator is not able to react to the change in the output current (which necessarily affects the output voltage $V_{OUT}$) which results in a step response which is suboptimal. To improve the step response and to further reduce the quiescent current of the regulator circuit the circuit of FIG. 2 is further optimized as illustrated in the example of FIG. 3.

Figure 3:
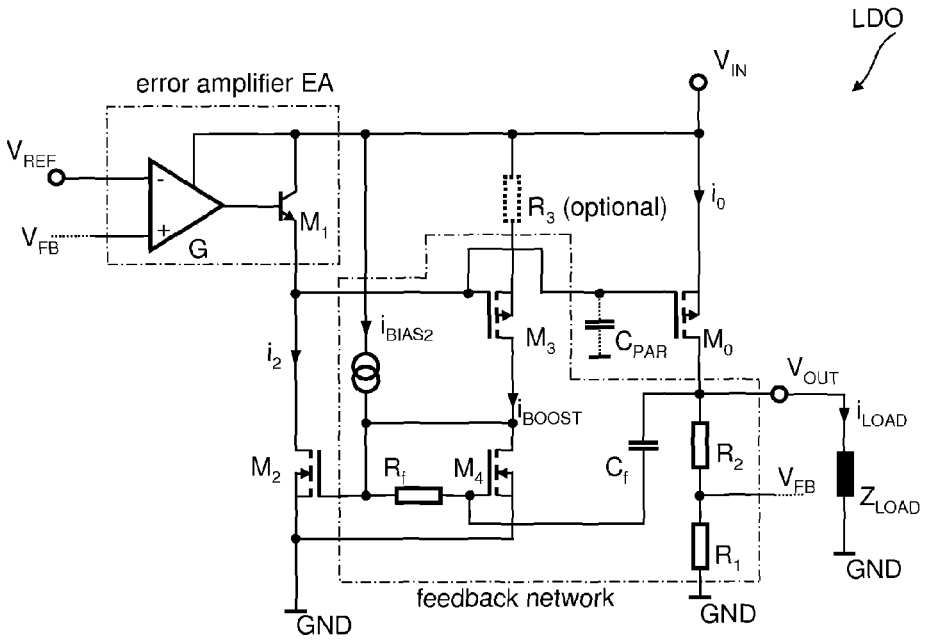
FIG. 3 is a circuit diagram illustrating an improved low-dropout regulator topology with reduced bias current.

As compared to the example of FIG. 2 the exemplary embodiment of FIG. 3 has an additional feedback loop established by the capacitor $C_f$ and the resistor $R_f$. The remaining circuit is essentially the same as the one shown in FIG. 2. The additional feedback loop affects the operation of the current minor. While the current mirror used in the example of FIG. 2 provides an output current $i_2(t)$ in accordance with eq. (3) the modified current minor provides an output current which follows the following equation:

$$i_2(t)=i_{BIAS2}+i_0(t)/k-g_{mM2}\cdot R_f\cdot C_f\cdot\partial V_{OUT}/\partial t. \quad (4)$$

The parameter $g_{mM2}$ is the transconductance of the current mirror output transistor $M_2$. As can be seen from eq. (4) and FIG. 3 not only the output voltage $V_{OUT}$ is fed back to the gain stage G of the error amplifier; the derivation $\partial V_{OUT}/\partial t$ of the output voltage is also fed back to the buffer stage of the error amplifier. This additional feedback loop increases the bias current in the buffer stage (emitter follower $M_1$) in response to a negative output voltage gradient $\partial V_{OUT}/\partial t$. As a result, the bias current $\mathbf{1}_{BIAS2}$ can be chosen even lower than the bias current $i_{BIAS1}$ in the example of FIG. 2 since the required bias current for charging/discharging the parasitic capacitance $C_{PAR}$ is adjusted by the help of the $\partial V_{OUT}/\partial t$ feedback loop. Furthermore the $\partial V_{OUT}/\partial t$ feedback allows for an improved (faster) step response and thus for a lower output voltage ripple.

In the example of FIG. 3 a further resistor $R_3$ may be connected in series to the sense transistor $M_3$ and the input transistor $M_4$ of the current mirror (formed by the transistors $M_4$ and $M_2$). This optional resistor degrades the proportionality between the load current $i_0$ and the sense current $i_{BOOST}$, which would be $i_0/k$ (as explained above with respect to FIG. 2) if the resistance of resistor $R_3$ was zero. Considering a non-negligible resistance of the resistor $R_3$ the sense current $i_{BOOST}$ is lower than $i_0/k$ at high load currents $i_0$ as compared to the case in which the resistance of $R_3$ is zero. However, an exact proportionality is not required in the present example. A significant series resistance in the input current path of the current minor, however, may ensure that the closed loop gain of the feedback branch providing the load current feedback is smaller than unity to ensure stability of the circuit. Generally the resistor $R_3$ may help to improve stability of the circuit.

Figure 4:
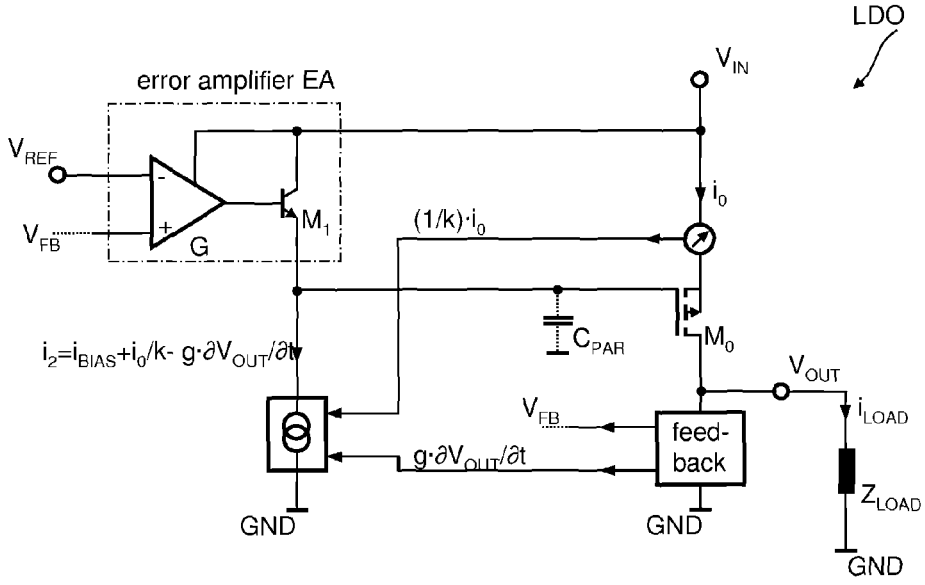
FIG. 4 is a simplified and generalized version of the example of FIG. 3.

In the following some general aspects of the circuit of FIG. 3 are summarized. A generalized circuit diagram of the example of FIG. 3 is illustrated in FIG. 4. The voltage regulator LDO illustrated in FIG. 3 includes a power transistor $M_0$ receiving an input voltage $V_{IN}$ and providing a regulated output voltage $V_{OUT}$ at an output voltage node. The power transistor has a control electrode (the gate electrode of the power MOS transistor in the present example) which receives a driver signal that is the gate voltage $V_G$ in the present example. The voltage regulator LDO further includes a reference circuit (not shown) for generating a reference voltage $V_{REF}$. Numerous appropriate reference circuits are known in the field and thus not further discussed here. For example, a band-gap reference circuit may be used in the present example to provide a temperature-stable reference voltage $V_{REF}$. A feedback network is coupled to the power transistor $M_0$. The feedback is used to establish at least two feedback loops. For this purpose the feedback network is configured to provide a first and a second and, optionally, a third feedback signal. The first feedback signal $V_{FB}$ represents the output voltage $V_{OUT}$, the second feedback signal $i_C$ represents the output voltage gradient $\partial V_{OUT}/\partial t$, and the third feedback signal $i_0/k$ represents the output current $i_{LOAD}$. The reference voltage $V_{REF}$ and the first feedback signal $V_{FB}$, which represents the output voltage $V_{OUT}$, are supplied to the input stage (gain stage G) of an error amplifier EA. The error amplifier EA is configured to generate the driver signal $V_G$ which depends on the reference voltage $V_{REF}$ and the first feedback signal $V_{FB}$. An output stage of the error amplifier EA (the emitter follower $M_1$ in the present example) is biased with a bias current $i_2$. This bias current is responsive to the second feedback signal $i_C$ and, as appropriate, the third feedback signal $i_0/k$. Furthermore, the feedback network may be configured to provide a third feedback signal that represents an output current of the power transistor. In this case the error amplifier comprises an output stage which is biased with a bias current responsive to the second and the third feedback signal.

The general description of the specific example illustrated in FIG. 3 also matches the simplified and generalized version thereof as illustrated in FIG. 4. The output transistor $M_2$ of the modified current minor in FIG. 3 is represented in FIG. 4 by the controllable current source which controls the bias current of the emitter follower $M_1$ which forms the output stage of the error amplifier EA. In accordance with eq. (4) the bias current is adjusted dependent on the load current $i_{LOAD}$ (represented by the sense current $i_0/k$ which can be seen as third feedback signal) and the output voltage gradient $\partial V_{OUT}/\partial t$ which can be seen as second feedback signal.

Although various exemplary embodiments of the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. It should be mentioned that features explained with reference to a specific figure may be combined with features of other figures, even in those where not explicitly been mentioned. Further, the methods of the invention may be achieved in either all software implementations, using the appropriate processor instructions, or in hybrid implementations that utilize a combination of hardware logic and software logic to achieve the same results. Such modifications to the inventive concept are intended to be covered by the appended claim.

What is claimed is:

1. A low-dropout voltage regulator comprising:

a power transistor configured to receive an input voltage and to provide a regulated output voltage at an output voltage node, the power transistor comprising a control electrode configured to receive a driver signal;

a reference circuit configured to generate a reference voltage;

a feedback network coupled to the power transistor and configured to provide a first feedback signal and a second feedback signal, the first feedback signal representing the output voltage and the second feedback signal comprising a time derivative of the output voltage; and an error amplifier configured to receive the reference voltage and the first feedback signal representing the output voltage, the error amplifier configured to generate the driver signal dependent on the reference voltage and the first feedback signal, wherein the error amplifier comprises an output stage which is biased with a bias current responsive to the second feedback signal.

2. The low-dropout voltage regulator of claim 1, wherein the feedback network is further configured to provide a third feedback signal that represents an output current of the power transistor and wherein the output stage of the error amplifier is biased with a bias current responsive to the second and the third feedback signal.

3. The low-dropout voltage regulator of claim 1, wherein the error amplifier comprises a gain stage and the output stage, the gain stage configured to amplify a difference between the reference voltage and the first feedback signal thus providing an amplified signal that is supplied to the output stage that generates the driver signal in accordance with the amplified signal.

4. The low-dropout voltage regulator of claim 3, wherein the output stage includes at least one transistor that is biased with the bias current.

5. The low-dropout voltage regulator of claim 3, wherein the output stage includes a further transistor that is coupled to the gain stage and is configured as an emitter or source follower that provides the driver signal, the further transistor being biased with the bias current.

6. The low-dropout voltage regulator of claim 1, wherein the bias current is set using a controllable current source coupled to the output stage of the error amplifier.

7. The low-dropout voltage regulator of claim 6, wherein controllable current source is a current minor that provides, as mirror current, an output current which is responsive to an input current and which is supplied, as bias current, to the output stage of the error amplifier.

8. The low-dropout voltage regulator of claim 6, wherein the second feedback signal is fed to the controllable current source, and wherein the controllable current source is configured to set the bias current in response to the second feedback signal.

9. The low-dropout voltage regulator of claim 2, wherein the bias current is set using a controllable current source coupled to the output stage of the error amplifier, wherein the second and the third feedback signals are fed to the controllable current source, and wherein the controllable current source is configured to set the bias current in response to the second and the third feedback signals.

10. The low-dropout voltage regulator of claim 9, wherein the third feedback signal is provided by a sense transistor coupled to the power transistor.

11. The low-dropout voltage regulator of claim 1, wherein the bias current is configured to be set using a current mirror that receives, as input current, a reference current and that provides, as output current, the bias current, which is responsive to the reference current.

12. The low-dropout voltage regulator of claim 11, wherein the current mirror is coupled to the output voltage node via a capacitor.

13. A low-dropout voltage regulator comprising:

a power transistor configured to receive an input voltage and to provide a regulated output voltage at an output voltage node, the power transistor comprising a control electrode configured to receive a driver signal;

a reference circuit configured to generate a reference voltage;

a feedback network coupled to the power transistor and configured to provide a first feedback signal and a second feedback signal, the first feedback signal representing the output voltage and the second feedback signal representing an output voltage gradient; and an error amplifier configured to receive the reference voltage and the first feedback signal representing the output voltage, the error amplifier configured to generate the driver signal dependent on the reference voltage and the first feedback signal, wherein the error amplifier comprises an output stage which is biased with a bias current responsive to the second feedback signal, and wherein the bias current is configured to be set using a current mirror that receives, as input current, a reference current and that provides, as output current, the bias current, which is responsive to the reference current, wherein:

the current minor comprises an input transistor receiving the reference current and an output transistor providing the bias current, the input and the output transistors having control terminals for controlling current flow through the respective transistor;

the control terminal of the input transistor is coupled to the output voltage node via a capacitor; and the control terminal of the input transistor and the control terminal of the output transistor are coupled via a resistor.

14. The low-dropout voltage regulator of claim 13, further comprising a further resistor coupled in series to the input transistor of the current mirror.

15. The low-dropout voltage regulator of claim 11, wherein the reference current is a sum of a quiescent current provided by a current source and a sense current representing a load current provided by the power transistor.

16. The low-dropout voltage regulator of claim 15, wherein the sense current is provided by a sense transistor coupled to the power transistor.

17. The low-dropout voltage regulator of claim 13, wherein the output voltage gradient is determined using a high pass filter.

18. The low-dropout voltage regulator of claim 17, wherein the high pass filter comprises a capacitor.

19. The low-dropout voltage regulator of claim 13, wherein the output voltage gradient represents a time derivative of the output voltage.

20. The low-dropout voltage regulator of claim 1, wherein the time derivative of the output voltage is implemented using a high pass filter.

21. The low-dropout voltage regulator of claim 20, wherein the high pass filter comprises a capacitor.

* * * * *

UNITED STATES PATENT AND TRADEMARK OFFICE

CERTIFICATE OF CORRECTION

PATENT NO. : 9,134,743 B2
APPLICATION NO. : 13/459817
DATED : September 15, 2015
INVENTOR(S) : Giovanni Bisson It is certified that error appears in the above-identified patent and that said Letters Patent is hereby corrected as shown below:

On the Title Page, Item (75) Inventors, Line 1, delete "Glovanni Bisson," and insert --Giovanni Bisson,--.

Claims

In Col. 7, line 66, claim 7, delete "source is a current minor that provides," and insert --source is a current mirror that provides,--.

In Col. 8, line 51, claim 13, delete "the current minor comprises" and insert --the current mirror comprises--.

Signed and Sealed this
Sixteenth Day of February, 2016

Michelle K. Lee

Michelle K. Lee
*Director of the United States Patent and Trademark Office*